US006254730B1

(12) United States Patent
Maciorewicz

(10) Patent No.: US 6,254,730 B1
(45) Date of Patent: Jul. 3, 2001

(54) IMPACT ANGLE CHANGING SHOWER

(75) Inventor: Jacek J. Maciorewicz, Brockville (CA)

(73) Assignee: James Ross Limited (CA)

( * ) Notice: Subject to any disclaimer, the term of this patent is extended or adjusted under 35 U.S.C. 154(b) by 0 days.

(21) Appl. No.: 09/246,489

(22) Filed: Feb. 9, 1999

(51) Int. Cl.[7] ..... D21F 1/32

(52) U.S. Cl. ..... 162/277; 162/275; 162/199; 162/263; 162/262; 198/495; 134/172; 137/238; 137/240; 239/562

(58) Field of Search ..... 162/48, 134, 184, 162/266, 272, 274, 275, 277; 198/495; 134/172, 122; 137/238, 240; 239/562, 243, 264, 263.1; 427/258, 261, 262, 267, 280, 288, 172

(56) References Cited

U.S. PATENT DOCUMENTS

| | | | | |
|---|---|---|---|---|
| 1,407,247 | * | 2/1922 | Brewster | 162/266 |
| 2,255,951 | | 9/1941 | Tomtlund | 92/44 |
| 3,291,681 | | 12/1966 | Wolf | 162/275 |
| 3,966,544 | | 6/1976 | Johnson | 162/199 |
| 4,087,320 | * | 5/1978 | Danahy et al. | 162/252 |
| 4,167,440 | * | 9/1979 | Falk | 162/277 |
| 5,282,575 | | 2/1994 | Krulick et al. | 239/255 |

* cited by examiner

*Primary Examiner*—Stanley S. Silverman
*Assistant Examiner*—Mark Halpern
(74) *Attorney, Agent, or Firm*—Mark Kusner

(57) ABSTRACT

The invention provides a novel impact angle changing shower for spraying a fluid upon a moving belt surface while the belt travels at a selected belt velocity. The shower includes nozzles journaled to rotation about an axis in a plane normal to the belt surface and transverse to the belt direction. The nozzles are continuously supplied with pressurized fluid and direct a fluid stream at a selected nozzle velocity and nozzle angle relative to the plane. The orientation of the nozzles is selected to optimize the desired function namely, to clean the belt surface without damaging the belt fabric or felt, or to penetrate the belt to increase fluid absorption by the belt. The fluid stream nozzle velocity can be decomposed using vector mathematics into two vector components: a belt velocity vector component parallel to the belt direction; and a belt impact velocity vector oriented at an impact angle defined relative to the normal transverse plane. By recognizing the effect of belt velocity on the performance of the nozzles, the optimum nozzle velocity and orientation can be determined for the desired function. Prior art selection of nozzle velocity and orientation relies on experience or trial and error rather than scientific analysis. Rotary actuators are used to rotate the nozzles about the transverse axis between: a belt penetration position where the impact angle equals zero and the belt velocity vector component of the nozzle velocity is equal to the belt velocity; and a belt surface chiselling position where the impact angle is greater than zero and less than 90 degrees, and preferably in the range between 10 to 45 degrees. The rotary actuator can be controlled with a timer to rotate the nozzles in a predetermined timed sequence. To oscillate the nozzles transversely across the belt for uniform coverage over the entire belt surface, either a separate transverse actuator can be provided or a single actuator that rotates and oscillates the nozzle mounting pipe can be included.

6 Claims, 3 Drawing Sheets

IMPACT ANGLE CHANGING SHOWER

TECHNICAL FIELD

The invention is directed to an impact angle changing shower for spraying a fluid stream on a moving belt, as in a felt fabric belt for a papermaking machine for example, where the impact angle and impact velocity of the stream are optimized for a chosen function, for example: surface cleaning or penetrating the belt surface for fluid absorption, by choosing a nozzle orientation angle and nozzle velocity that compensates for the effect of belt velocity.

BACKGROUND OF THE ART

A common arrangement in many industrial processes includes a machine having an endless looping belt upon which the belt surface is cleaned or subjected to fluid spray, such as in the cleaning and re-conditioning of felt fabric belts in paper making machinery. It will be understood however, that the present invention is not restricted to any type of machinery, but can have application to any such process machinery.

In the paper making process, a felt fabric belt is used to absorb water from newly manufactured paper webs. Periodic cleaning of the fabric belt surface is required to remove fibers, fillers, pitch or other particles which would otherwise adhere to the belt surface, impair the paper finish and impede operation of the paper making machine. In order to clean the surface of these contaminants, fluid nozzles are commonly directed at the surface at an angle between 10 and 45 degrees to chisel or skive the surface with jet energy.

In general, very little engineering effort has gone into optimizing the design of such cleaning nozzles. The velocity of the stream of fluid and the angular orientation to the moving belt are generally determined through trial and error or by experience of the machine builders.

However, particularly in the case of a felt fabric belt, the surface can be damaged significantly by improper orientation of fluid streams. If the nozzle angle is excessively acute relative to the belt, the belt surface may be damaged by raising and shredding the surface fibers of the felt.

In the case of fabric felt belts, absorbed penetrating water is required to supply energy within the felt to re-open and restore the compressed caliper in the press nip. During passage through the paper making machine, the felt fabric belt is repeatedly dried and then pressed against a wet paper web to absorb water from the paper web. The fabric belt is under tension as it passes over rollers and is compressed as the belt rides over and between rollers. Compaction of the fabric reduces its absorption capacity and increases the resistance to water removal from it by suction devices.

To ensure that proper operation of the felt fabric belt, it is necessary to re-open the voids between fibers and restore the compressed thickness of the belt. A felt fabric belt which is highly compressed with compact fibers has reduced capacity to absorb water from the paper web and requires excessive de-watering effort must be replaced with a new fabric belt.

Injecting water under pressure to the interior of the felt fabric, designers of paper making machinery attempt to re-open and restore the compressed caliper of the felt fabric belt by expanding the thickness of the belt, separating fibers to restore the porosity and void ratio of the belt.

Conventionally, in order to restore the compressed caliper, a separate shower arrangement is provided that directs fluid streams at the belt normal to the belt surface and transverse to the belt direction.

A significant disadvantage of such prior art devices is that the optimum use of fluid and optimum angle of impact is not achieved since heretofore, the design of nozzles and their angular orientation relative to the belt has been decided on the basis of trial and error, or experience with similar applications. Excessive fluid is used when an optimum impact angle is not used since fluid merely splashes off the belt surface without doing useful work and possibly damaging the belt surface.

The present inventor however, has recognized that the belt velocity has significant effect upon the optimum velocity and optimum angular orientation of the nozzle stream of fluid.

It is an object of the present invention to provide a shower with nozzles which can be utilized for both functions of cleaning the belt surface and penetrating the belt itself to restore the compressed caliper.

It is a further object of the invention to provide an impact angle changing shower which can be adapted to compensate for the variation in impact velocity and impact angle caused by the belt velocity.

It is a further object of the invention to provide an actuating mechanism which can rotate the nozzles about a horizontal axis and which can selectively oscillate the nozzles axially transverse to the belt direction in order to provide complete uniform coverage of the entire belt surface.

DISCLOSURE OF THE INVENTION

The invention provides a novel impact angle changing shower for spraying a fluid upon a moving belt surface while the belt travels at a selected belt velocity. The shower includes nozzles journaled to rotate about an axis in a plane normal to the belt surface and transverse to the belt direction. The nozzles are continuously supplied with pressurised fluid and direct a fluid stream at a selected optimum nozzle velocity and optimum nozzle angle relative to the plane.

The orientation of the nozzles is selected to optimise the desired function, namely, to clean the belt surface without damaging the belt fabric or felt, or to penetrate the belt to increase fluid absorption by the belt.

The fluid stream nozzle velocity and angular orientation can be reduced using vector mathematics into two velocity vector components: a belt velocity vector component parallel to the belt direction; and a belt impact velocity vector oriented at an impact angle defined relative to the normal transverse plane.

By recognising the predicable effect of belt velocity on the performance of the nozzles, the optimum nozzle velocity and angular orientation can be determined for the desired function. Prior art selection of nozzle velocity and orientation relies on experience or trial and error rather than scientific analysis.

Rotary actuators are used to rotate the nozzles about the transverse axis between: a belt penetration position where the impact angle equals zero and the belt velocity vector component of the nozzle velocity is equal to the belt velocity; and a belt surface chiselling position where the impact angle is greater than zero and less than 90 degrees, and preferably in the range between 10 to 45 degrees.

The rotary actuator can be controlled with a timer to rotate the nozzles in a predetermined timed sequence or can be controlled using the change of direction signal from the transverse oscillator to activate rotary action. To oscillate the nozzles transversely across the belt for uniform coverage over the entire belt surface, either a separate transverse actuator can be provided or a single actuator that simultaneously rotates and oscillates the nozzle mounting pipe can be included.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
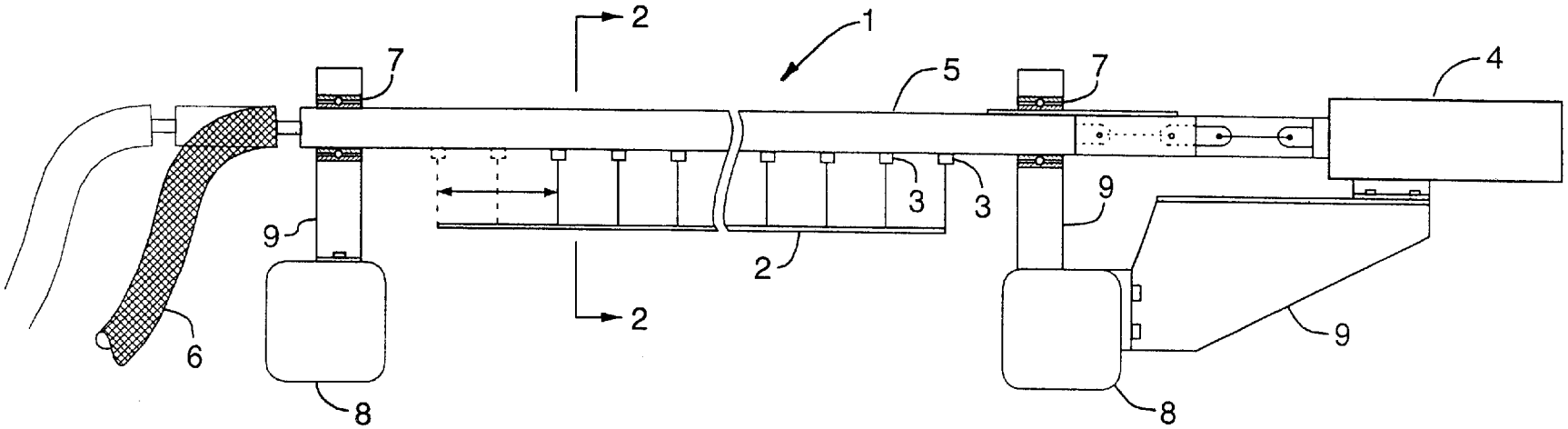
FIG. 1 is a partial sectional elevation view along a plane normal and transverse to the belt direction showing the belt beneath a horizontal fluid supply pipe and a row of downwardly directed nozzles, with fluid supply hose to the left and an oscillating actuator to the right, the oscillating leftmost positions of the nozzles and supply pipe shown in dashed outline.

FIG. 1 illustrates a general arrangement of an impact angle changing shower 1 which sprays fluid on a moving belt 2 using high pressure high velocity needle jet nozzles 3 that are oscillated in the transverse direction with a transverse actuator 4 as indicated in dashed outline. By oscillating the shower at a constant speed over the moving belt 2, the shower can provide uniform coverage of the belt surface to be cleaned or penetrated. As the belt 2 travels at a generally constant belt velocity, the nozzles 3 spray a high pressure shower of fluid to clean the belt surface and to penetrate the belt fabric restoring the compressed caliper and reopening the voids of the belt 2. The invention is equally applicable to non-fabric belts that can be cleaned more thoroughly by varying the impact angle of fluid spray, such a wire mesh belts or other belt-like conveyors commonly used in industrial processes.

In the embodiment illustrated, the shower 1 comprises a series of nozzles 3 disposed on a rotatable shower supply pipe 5. The hollow supply pipe 5 is provided with high pressure fluid, such as treated water, through a flexible supply hose 6. The supply pipe 5 is supported to rotate about a horizontal axis in bearings 7 mounted to the paper machine frame 8 with support brackets 9.

Figure 2:
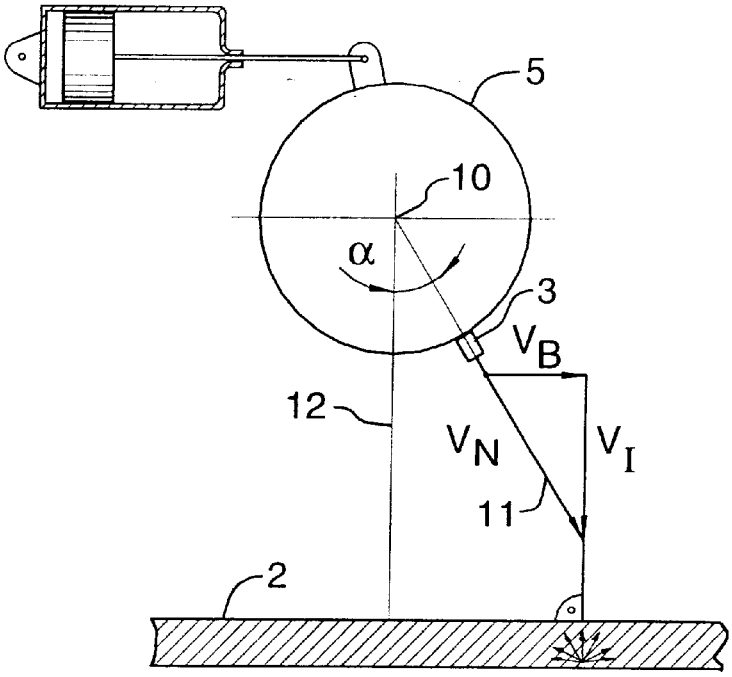
FIGS. 2–5 are progressive sectional views along line 2—2 of FIG. 1 showing various rotary positions of the nozzle and the resulting changes to the impact velocity vector $V_1$ and impact angle β, also indicating a pneumatic cylinder schematically as a separate rotary actuator.

As illustrated in FIG. 2, the nozzles 3 rotate about an axis 10 in a plane normal to the belt surface 2 and transverse to the belt direction (to the right as drawn in FIGS. 2 to 5). The nozzles 3 direct a fluid stream 11 at a selected nozzle velocity $V_N$ and nozzle angle a relative to the plane 12. As indicated in FIGS. 2–5 and well known to those skilled in the art, the velocity and angular orientation of the fluid stream 11 can be described and analyzed in the form of velocity vectors. As best shown in the general cases of FIGS. 3 and 5, the nozzle velocity vector $V_N$ has a belt velocity vector component $V_B$ which is parallel to the belt direction (to the right as drawn) and an impact velocity vector $V_1$ which is oriented relative to the normal transverse plane 12 at an impact angle β.

Ordinarily the belt velocity is fixed by other factors at a constant velocity $V_B$. However, the belt velocity may be variable, and the rotary actuation of the nozzle angle α may be determined through use of a belt velocity sensor that provides an input signal to the rotary actuator. Also for practical reasons, the nozzle velocity $V_N$ is usually a constant value since the characteristics of the nozzle 3 are generally not variable and the fluid pressure inside the supply pipe 5 is generally maintained at a constant value as well. As a result therefore, it is a simple trigonometric exercise to derive the required nozzle angle α for any optimum impact velocity $V_1$ and impact angle β desired in view of the generally constant values for the belt velocity $V_B$ and nozzle velocity $V_N$.

Figure 4:
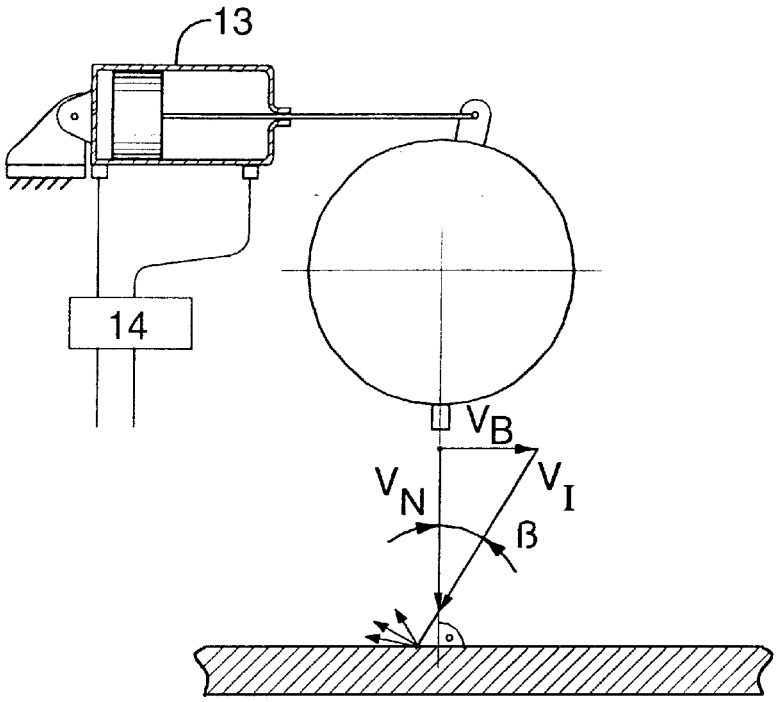

In order to set the nozzle angle a, rotary actuators such as the pneumatic cylinder 13 illustrated in FIGS. 2 and 4 are provided for selectively rotating the nozzles 3 and supply pipe 5 about the transverse axis 10. For optimum belt penetration, the rotary actuating cylinder 13 rotates the nozzles 3 to the belt penetration position shown in FIG. 2 wherein the impact angle β equals zero and the belt velocity vector component $V_B$ is equal to the belt velocity.

In the belt penetration position, the resultant impact velocity vector $V_1$ is therefore directed normal to the belt surface 2. As a result, optimum penetration of the high velocity fluid stream into the interior of the belt enables the jet energy to reopen the pores of the belt, force the fibers of the belt apart and restore the compressed belt caliper.

Figure 3:
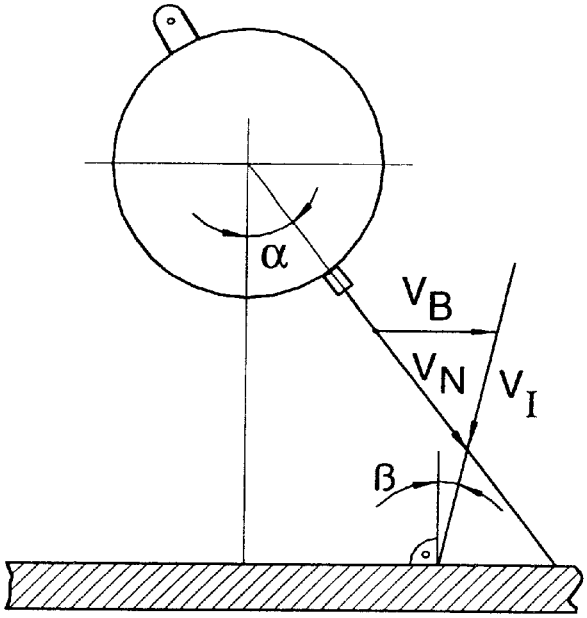
Figure 5:
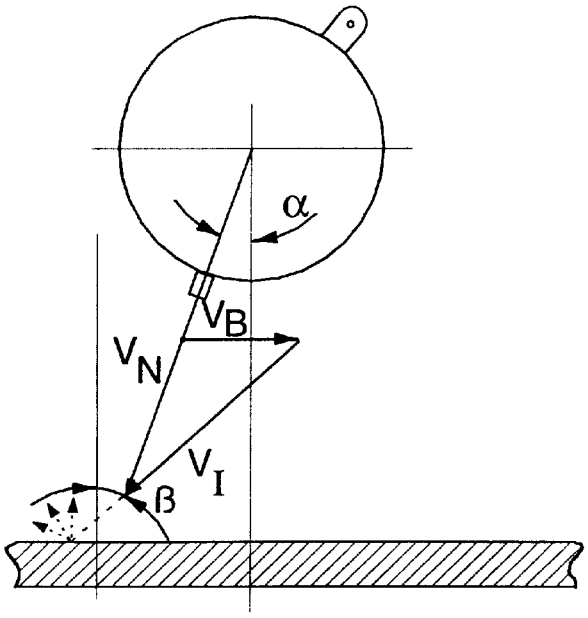

In order to provide the optimum belt surface chiseling position, α nozzle angle a is chosen to provide a non-zero impact angle β that is greater than zero, but less than 90 degrees at the extreme maximum. Three different positions and values for impact angle β are shown in FIGS. 3, 4 and 5. From experience, it is considered that the preferred range of β is between 10 and 45 degrees. If the impact angle β is excessive, water bounces off the belt surface and damages the belt surface 2 creating pits by dislodging fibers.

The rotary actuator 13 includes timer controls for rotating the nozzles 3 in a predetermined timed sequence or counter controls that will rotate the nozzles 3 after a predetermined number of oscillating strokes. For example, a timer/counter control 14 can include a reversing solenoid switch controlled with an electrical signal provided by the paper making machine control panel. The rotary actuator air cylinder 13 or the rotating supply pipe 5 can have means to limit the rotation, such as mechanical stops or limit switches. The stops or limit switches include a fine adjustment to precisely optimize the belt penetration position and chiseling position. The transverse actuator 4 and rotary actuator 13 can be combined in a single unit to simultaneously rotate the nozzles 3 and oscillate the nozzles 3 relative to the belt surface 2.

As a result, an extremely simple, but effective impact angle changing shower is provided which can be optimally set at a belt penetration position to restore the compressed caliper of the belt, providing jet energy transverse to the belt and alternatively, can be set at a belt surface chiseling position to utilize jet energy at an acute angle to the belt surface to remove surface contamination, such as fibers, fillers, pitch and solid particles.

Due to the effect of the belt velocity in order to change the nozzle angle orientation a, moving the nozzles from the belt penetration position shown in FIG. 2 to a chiseling position, shown in the other FIGS. 2–5. The rotation of the nozzles 3 is preferably in the range of α between 10 and 20 degrees. It can be seen therefore, that a relatively small degree of rotation together with transverse oscillation enables a simple device to be designed in a highly effective manner.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. An impact angle changing shower for spraying a fluid upon a moving belt surface while the belt travels at a pre-determined substantially constant belt velocity, the shower comprising:

nozzle means, journaled for rotation about an axis transverse to the belt direction, and in communication with a source of pressurised fluid, for directing a fluid stream at a selected nozzle velocity and nozzle angle relative to a plane, wherein the plane is normal to the belt and intersects said axis transverse to the belt direction, the nozzle velocity comprising a belt velocity vector component parallel to the belt direction and an impact velocity vector at an impact angle defined relative to said normal transverse plane; and rotary actuating means for selectively rotating the nozzle means about said axis between:

a belt penetration position wherein the impact angle equals zero and the belt velocity vector component of the nozzle velocity is equal to the pre-determined substantially constant belt velocity; and a belt surface chiselling position wherein the impact angle is greater than zero and less than 90 degrees.

2. A shower according to claim 1 wherein the impact angle in the belt chiseling position is in the range between 10 to 45 degrees.

3. A shower according to claim 1 wherein the nozzle means comprise a plurality of nozzles disposed on a rotatable shower supply pipe.

4. A shower according to claim 1 wherein the rotary actuating means include timer means for rotating the nozzles in a predetermined timed sequence.

5. A shower according to claim 1 including:

transverse actuating means for selectively oscillating the nozzle means axially along said axis.

6. A shower according to claim 5 wherein the rotary actuating means include counter control means for rotating the nozzles after a predetermined number of oscillations.

* * * * *